US011444385B2

(12) United States Patent
Tai et al.

(10) Patent No.: US 11,444,385 B2
(45) Date of Patent: Sep. 13, 2022

(54) ANTENNA STRUCTURE AND MOBILE DEVICE INCLUDING THE SAME

(71) Applicant: WISTRON NEWEB CORPORATION, Hsinchu (TW)

(72) Inventors: Chih-Feng Tai, Hsinchu (TW); Kuan-Hsun Lai, Hsinchu (TW); Kuei-Cheng Wang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 7 days.

(21) Appl. No.: 17/236,071

(22) Filed: Apr. 21, 2021

(65) Prior Publication Data

US 2022/0255232 A1 Aug. 11, 2022

(30) Foreign Application Priority Data

Feb. 5, 2021 (TW) ..... 110104403

(51) Int. Cl.

| | |
|---|---|
| ***H01Q 13/10*** | (2006.01) |
| ***H01Q 1/24*** | (2006.01) |
| ***H01Q 1/48*** | (2006.01) |
| ***H01Q 5/307*** | (2015.01) |
| *H01Q 21/29* | (2006.01) |
| *H01Q 1/22* | (2006.01) |
| *H01Q 3/26* | (2006.01) |

(52) U.S. Cl.

CPC ..... *H01Q 13/10* (2013.01); *H01Q 1/24* (2013.01); *H01Q 1/48* (2013.01); *H01Q 5/307* (2015.01); *H01Q 1/2258* (2013.01); *H01Q 3/2605* (2013.01); *H01Q 21/293* (2013.01)

(58) Field of Classification Search

CPC ..... H01Q 13/10; H01Q 5/307; H01Q 1/24; H01Q 1/48; H01Q 1/2258; H01Q 3/2605; H01Q 21/293

See application file for complete search history.

(56) References Cited

U.S. PATENT DOCUMENTS

2018/0026330 A1* 1/2018 Wu ..... H01Q 5/371 343/703

* cited by examiner

*Primary Examiner* — Joseph J Lauture

(74) *Attorney, Agent, or Firm* — McClure, Qualey & Rodack, LLP

(57) ABSTRACT

An antenna structure and a mobile device including the same are provided. The mobile includes a metal back cover and an antenna structure. The metal back cover has an open slot. The antenna structure includes a feeding metal radiator, a first grounded metal radiator, a second grounded metal radiator, and a substrate. The feeding metal radiator includes a first radiating portion, a first connecting portion, a second radiating portion and a feeding portion. The first radiating portion extends along a second direction from one side of the opening slot. The second radiating portion is coupled with the first radiating portion through the first connecting portion. The feeding portion is connected to the second radiating portion and extends along the second direction from one side of the open slot.

16 Claims, 5 Drawing Sheets

ANTENNA STRUCTURE AND MOBILE DEVICE INCLUDING THE SAME

CROSS-REFERENCE TO RELATED PATENT APPLICATION

This application claims the benefit of priority to Taiwan Patent Application No. 110104403, filed on Feb. 5, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and more particularly to an antenna structure suited for an open slot structure for supporting WI-FI® 6E.

BACKGROUND OF THE DISCLOSURE

The present open slot antenna structure does not support WI-FI® 6E frequency band. For supporting WI-FI® 6E frequency band, it should be added more antenna space in the present antenna structure. However, in some electronic products, a narrow frame design is adopted. In this case, changing the appearance structure will cause the product to be redesigned, which is not cost-effective.

Therefore, how to improve the structural design under the conventional open slot antenna structure so that it can further support the frequency band required by WI-FI® 6E (5.925 GHz~7.125 GHz) to overcome the above-mentioned shortcomings has become a solution for this business.

SUMMARY OF THE DISCLOSURE

In response to the above-referenced technical inadequacies, the present disclosure provides an improved antenna structure to supporting WI-FI® 6E.

In one aspect, the present disclosure provides an antenna structure, disposed on a metal back cover. The metal back cover has an open slot. The open slot has an open end and a closed end which are arranged along a first direction. The open slot has a first side and a second side which are arranged along a second direction. The first direction is perpendicular to the second direction.

The antenna structure includes a feeding metal radiator, a first grounded metal radiator, a second grounded metal radiator, and a substrate. The feeding metal radiator is disposed on the first side of the open slot. The feeding metal radiator includes a first radiating portion, a first connecting portion, a second radiating portion and a feeding portion. The first radiating portion is extended along the second direction from the first side of the open slot and overlapped by a first portion of the open slot.

The first connecting portion is connected to the first radiating portion. The second radiating portion is coupled with the first radiating portion via the first connecting portion. The first radiating portion, the first connecting portion and the second radiating portion are arranged along the first direction. The feeding portion is connected to the second radiating portion and is extended along the second direction from the first side of the open slot and is overlapped by at least one portion of the open slot. The feeding portion has a feeding point coupled with a signal source.

The first grounded metal radiator includes a first extension portion and a first extension portion. The first extension portion is extended along the second direction from the second side of the open slot and overlapped by a second portion of the open slot. The first ground portion is coupled with the first extension portion and a ground potential.

The second grounded metal radiator includes a second extension portion and a second ground portion. The second extension portion is extended along the second direction from the second side of the open slot and is overlapped by a fourth portion of the open slot. The second extension portion is separated from the first extension portion by a first gap. The second ground portion is coupled with the second extension portion, the first ground portion and the ground potential. The feeding metal radiator, the first grounded metal radiator and the second grounded metal radiator are disposed on the substrate.

In another aspect, the present disclosure provides a mobile device. The mobile device includes a metal back cover and an antenna structure. The metal back cover has an open slot. The open slot has an open end and a closed end which are arranged along a first direction and has a first side and a second side which are arranged along a second direction. The first direction is perpendicular to the second direction. The antenna structure includes a feeding metal radiator, a first grounded metal radiator, a second grounded metal radiator and a substrate. The feeding metal radiator is disposed on the first side of the open slot. The feeding metal radiator has a first radiating portion, a first connecting portion, a second radiating portion and a feeding portion.

The first radiating portion is extended along the second direction from the first side of the open slot and is overlapped by a first portion of the open slot. The first connecting portion is connected to the first radiating portion. The second radiating portion is coupled with the first radiating portion via the first connecting portion. The first radiating portion, the first connecting portion and the second radiating portion are arranged along the first direction.

The feeding portion is connected to the second radiating portion and is extended along the second direction from the first side of the open slot and is overlapped by at least one portion of the open slot. The feeding portion has a feeding point coupled with a signal source.

The first grounded metal radiator includes a first extension portion and a first ground portion. The first extension portion is extended along the second direction from the second side of the open slot and is overlapped by a second portion of the open slot.

The first ground portion is coupled with the first extension portion and a ground potential. The second grounded metal radiator includes a second extension portion and a second ground portion. The second extension portion is extended along the second direction from the second side of the open slot and is overlapped by a fourth portion of the open slot. The second extension portion is separated from the first extension portion by a first gap.

The second ground portion is coupled with the second extension portion, the first ground portion and the ground potential. The feeding metal radiator, the first grounded metal radiator and the second grounded metal radiator are disposed on the substrate.

One of the beneficial effects of the present disclosure is that the antenna structure provides the improved design concept of the open slot antenna structure, increases the coupling between the antenna radiator path and the feeding point, and resonates the required frequency band of WI-FI® 6E (5.925 GHz~7.125 GHz), so that the design of communication products does not need to increase space for the antenna design for the WI-FI® 6E communication frequency band, and there is no need to make additional changes in the mechanism. The number of antennas can be reduced, and the molding cost can also be reduced.

Furthermore, based on the antenna structure provided by the present disclosure, on the premise of preserving the gap between the first extension portion and the second extension portion, it further improves the overall performance of the antenna structure by adjusting the gap between the second grounded metal radiator and the feeding portion and adjusting the size of the second grounded metal radiator in the first direction.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
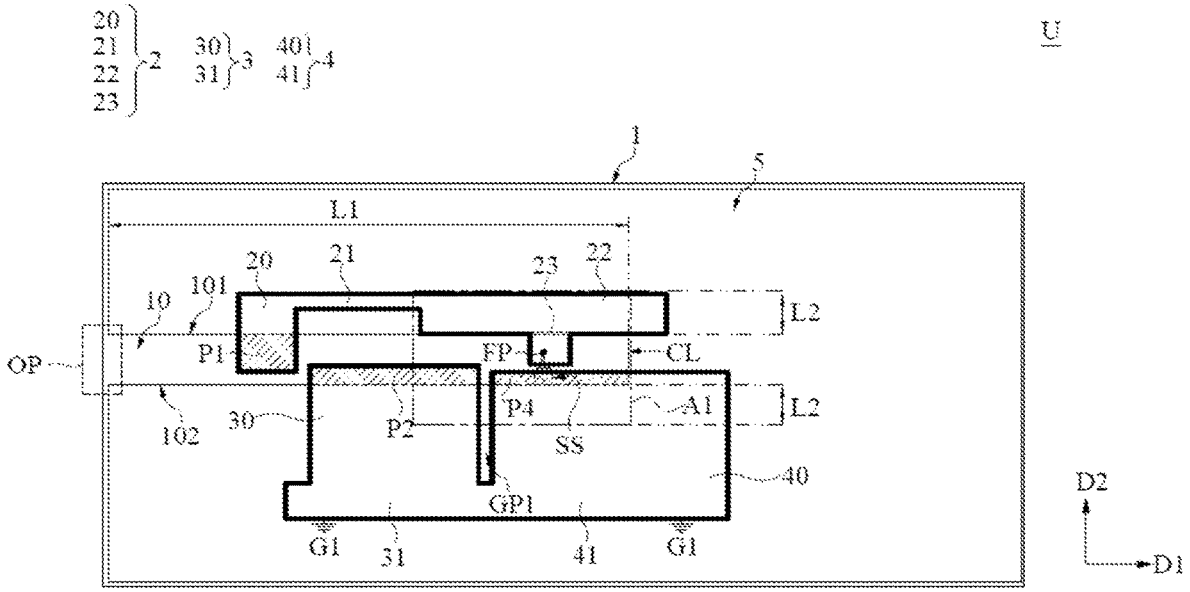
FIG. 1 is a schematic top view of the antenna structure in a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1, FIG. 1 is a top schematic view of the antenna structure in the first embodiment of the present disclosure. The first embodiment provides a mobile device including a metal back cover 1 and an antenna structure U. The antenna structure U includes a feeding metal radiator 2, a first grounded metal radiator 3, a second grounded metal radiator 4, and a substrate 5. The metal back cover 1, feeding metal radiator 2, the first grounded metal radiator 3, and the second grounded metal radiator 4 may be made of metal materials, such as copper, silver, aluminum, iron, or alloys thereof.

The metal back cover 1 may be used in a metal casing of the mobile device. In some embodiments, the metal back cover 1 may be a metal upper case of a laptop or a metal back cover of a tablet but not limited thereto. The metal back cover 1 has an open slot 10. The open slot 10 has an open end OP and closed end CL which are arranged along a first direction D1. The open slot 10 has a first side 101 and a second side 102 which are arranged along a second direction D2. The first direction D1 is perpendicular to the second direction D2. The antenna structure U may further include a non-conductive material filled into the open slot 10.

The feeding metal radiator 2 is disposed on the first side 101 of the open slot 10. The feeding metal radiator 2 includes a first radiating portion 20, a first connecting portion 21, a second radiating portion 22, and a feeding portion 23. As shown in FIG. 1, the first radiating portion 20 extends from the first side 101 of the open slot 10 along the second direction D2 and overlaps a first portion P1 of the open slot 10 (the slash filled in FIG. 1) which is adjacent to the open end OP. The first connecting portion 21 is connected to the first radiating portion 20. The second radiating portion 22 is connected to the first radiating portion 20 via the first connecting portion 21. The first radiating portion 20, the first connecting portion 21 and the second radiating portion 22 are arranged along the first direction D1.

The feeding portion 23 is connected to the second radiating portion 22 and extends along the second direction D2 from the first side 101 of the open slot 10. The feeding portion 23 overlaps at least one portion of the open slot 10. The at least one portion of the open slot 10 is adjacent to the closed end CL. The feeding portion 23 has a feeding point FP coupled with a signal source SS. A vertical projection of the feeding point FP onto the substrate 5 is in a first area A1. The first area A1 is adjacent to the closed end CL of the open slot 10.

It should be noted that the open slot 10 has a first predetermined length L1 in the first direction D1. Under different conditions, the first predetermined length L1 is in a range of 15 mm to 20 mm. In the first direction D1, the first area A1 is positioned within a half of the first predetermined length L1 of the open slot from the closed end CL. And in the second direction D2, the first area A1 exceeds a second predetermined length L2 over the first side 101 and the second side 102 respectively in the second direction D2. The position of the feeding point FP in the first direction D1 may adjust VSWR of 2.4 GHz to 2.5 GHz. The gain of the antenna structure U may be adjusted by the position of the feeding point FP in the second direction D2.

Specifically, the first area A1 is an energy feeding area. The energy is entered from the feeding point FP of the feeding metal radiator 2. The feeding metal radiator 2 is coupling to the open slot 10 to resonate radiation energy of a first frequency band and a second frequency band. The first frequency band is in a range of 2.4 GHz to 2.5 GHz. The second frequency band is in a range of 5 GHz to 8 GHz. It should be noted that longer path including the first radiating portion 20, the first connecting portion 21 and the feeding portion 23 provides the first frequency band, and shorter path including the feeding portion 23 and the second radiating portion 22 provides the second frequency band.

Furthermore, the first grounded metal radiator 3 includes a first extension portion 30 and a first ground portion 31. The first extension portion 30 extends from the second side 102 of the open slot 10 along the second direction D2 and overlaps a second portion P2 of the open slot 10. The first ground portion 31 is coupled with the first extension portion 30 and a ground potential G1.

In this embodiment, the feeding metal radiator 2 is coupling to the first grounded metal radiator 3 to resonate and generate a third frequency band which is in a range of 5.15 GHz to 5.85 GHz. The bandwidth and impedance matching of 5.15 GHz to 5.85 GHz can be adjusted by the first grounded metal radiator 3. The bottom edge of the first ground portion 31 of the first grounded metal radiator 3 may be partially or fully connected to the ground potential G1 via copper pad of substrate 5 in a soldering way. As shown in FIG. 1, even the first extension portion 30 is a simple rectangular, it could adjust the bandwidth and impedance matching of 5.15 GHz to 5.85 GHz.

Furthermore, the second grounded metal radiator 4 includes a second extension portion 40 and a second ground portion 41. The second extension portion 40 extends from the second side 102 of the open slot 10 in the opposite direction of the second direction D2. The second extension portion 40 overlaps a fourth portion P4 of the open slot 10 and is separated from the first extension portion 30 by a gap GP1. The second ground portion 41 is coupled with the second extension portion 40, the first ground portion 31 and the ground potential G1.

The feeding metal radiator 2 is coupling to the second grounded metal radiator 4 to resonate and generate a fourth frequency band, such as WI-FI® 6E mode. In addition, the bandwidth and impedance matching of 5.925 GHz to 7.125 GHz is adjusted by altering the coupling relationship, i.e., a gap between the second grounded metal radiator 4 and the feeding portion 23. The bottom edge of the second ground portion 41 of the second grounded metal radiator 4 may be partially or fully connected to the ground potential G1 via copper pad of substrate 5 (e.g., a PCB) in a soldering way.

Referring to FIG. 1, the bandwidth of 5.925 GHz to 7.125 GHz can be adjusted by altering the length of the second grounded metal radiator 4 in the first direction D1. This part would be explained in the following embodiment. In this embodiment, the first frequency band to the fourth frequency band have a frequency range from small to large.

In the previous embodiment, the antenna structure U provides the improved design concept of the open slot antenna structure, increases the coupling between the antenna radiator path and the feeding point, and resonates the required frequency band of WI-FI® 6E (5.925 GHz~7.125 GHz), so that the design of communication products does not need to increase space for the antenna design for the WI-FI® 6E communication frequency band, and there is no need to make additional changes in the mechanism. The number of antennas can be reduced, and the molding cost can also be reduced.

Second Embodiment

Figure 2:
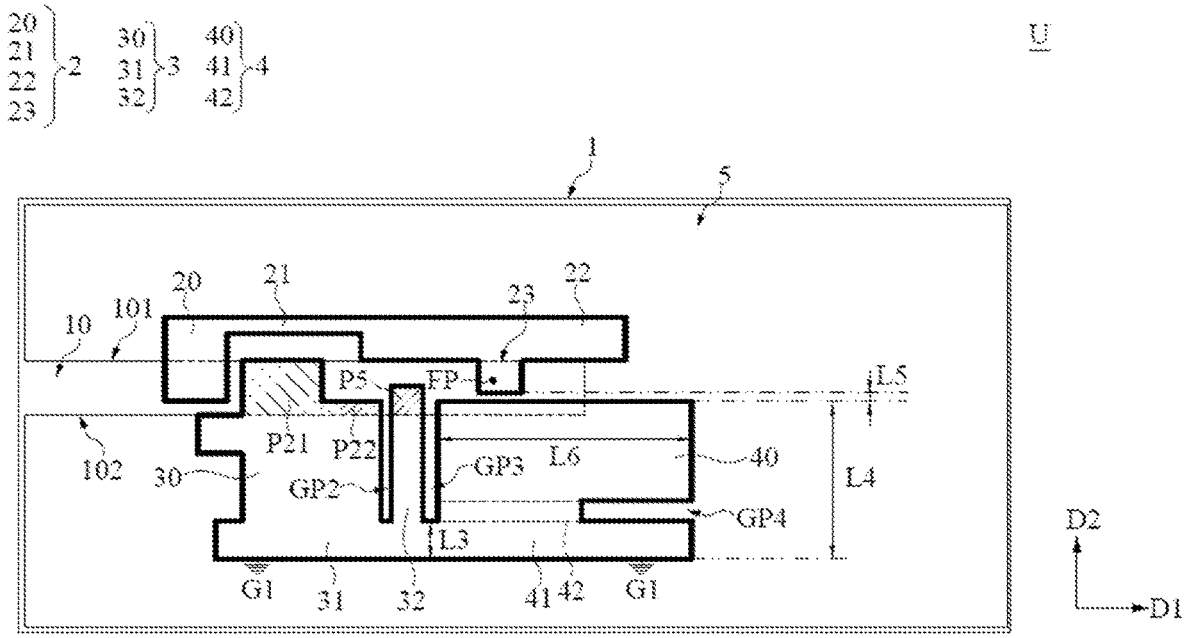
FIG. 2 is a schematic top view of the antenna structure in a second embodiment of the present disclosure.

Referring to FIG. 2, FIG. 2 is a top schematic view of the antenna structure in the second embodiment of the present disclosure. The difference between the second embodiment and the first embodiment is that on the premise of preserving the gap between the first extension portion 30 and the second extension portion 40, the overall performance of the antenna structure U can be further improved by adjusting the structures of the first grounded metal radiator 3 and the second grounded metal radiator 4 provided by the second embodiment. In addition, the other structural features shown in the second embodiment are similar to the description of the foregoing embodiment, and would not be repeated here. In addition, for the clarity of the figures, some labels are omitted.

In the second embodiment, the first grounded metal radiator 3 further includes a third extension portion 32 positioned between the first extension portion 30 and the second extension portion 40. The third extension portion 32 is connected to the first ground portion 31 and is extended from the second side 102 of the open slot 10 in the opposite direction of the second direction D2. The third extension portion 32 overlaps a fifth portion P5 of the open slot 10. The third extension portion 32 is separated from the first extension portion 30 by a gap GP2 and is separated from the second extension portion 40 by a gap GP3. The gap GP3 is in a range of 0.2 mm to 0.8 mm. The mode of 5.15 GHz to 5.85 GHz would be mainly affected by the gap GP3 when the gap GP3 is becoming wider by adjusting the first grounded metal radiator 3. And it would indirectly affect the mode of WI-FI® 6E.

The first extension portion 30 further overlaps a first sub-portion P21 and a second sub-portion P22 of the open slot 10. The first sub-portion P21 is completely across the open slot 10. The second sub-portion P22 is across a part of the open slot 10. The bandwidth and impedance matching of the antenna structure U in 5.15 GHz to 5.85 GHz by altering the shape of the first extension portion 30.

In addition, the second grounded metal radiator 4 further includes a second connecting portion 42. The second connecting portion 42 is connected between the second ground portion 41 and the second extension portion 40, and a gap GP4 is between the second ground portion 41 and the second extension portion 41. An un-connected part between the second ground portion 41 and the second extension portion 40 forms the gap GP4. Specifically, the gap GP4 forms a notch in the second grounded metal radiator 4. The electric current of the second grounded metal radiator 4 can be changed by adjusting the size of the gap GP4, so that the mode of the WI-FI® 6E can be adjusted.

It should be noted that a length of a connected part between the first ground portion 31 and the second ground portion 41 along the second direction D2 has a third predetermined length L3, the second grounded metal radiator 4 has a fourth predetermined length L4 along the second direction D2. The third predetermined length L3 is smaller than or equal to a half of the fourth determined length L4.

In other words, the ratio of the third predetermined length L3 to the fourth predetermined length L4 may be less than or equal to 1:2.

A gap between the feeding portion 23 and the second extension portion 40 has a fifth predetermined length L5. The fifth predetermined length L5 can be adjusted by changing the length of the second grounded metal radiator 4 in the second direction D2. Preferably, the fifth predetermined length L5 is in a range of 0.1 mm to 3 mm. The coupling amount between the second grounded metal radiator 4 and the feeding metal radiator 2 is determined by the fifth predetermined length L5 and affects the fourth frequency band. That is, the frequency band is required by WI-FI® 6E (5.925 GHz~7.125 GHz).

The second extension portion 40 has a sixth predetermined length L6 in the first direction D1 which is in a range of 7 mm to 15 mm. On the premise of preserving the gap GP3, the resonance frequency of the antenna structure U would be affected by altering the sixth predetermined length L6 in the first direction D1.

Figure 3:
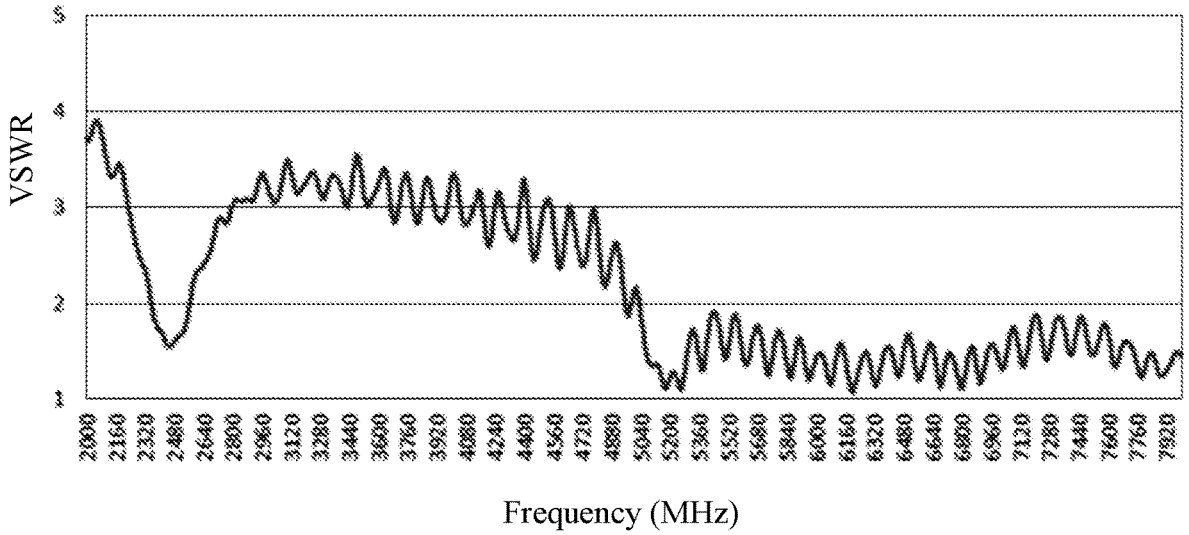
FIG. 3 is a diagram of a voltage standing wave ratio of the antenna structure under different frequencies according to FIG. 2.

Referring to FIG. 3, FIG. 3 is a diagram of a voltage standing wave ratio of the antenna structure under different frequencies according to FIG. 2. It can be seen from FIG. 3 that the antenna structure U of the present disclosure operates in the first frequency band (2.4 GHz to 2.5 GHz frequency band), the second frequency band (5 GHz to 8G Hz frequency band), the third frequency band (5.15 GHz to 5.85 GHz frequency band) and the fourth frequency band (WI-FI® 6E, 5.925 GHz to 7.125 GHz band), its VSWR has a good performance. And especially for the frequency band of 5.04 GHz to 7.12 GHz, its VSWR can be under 2.

Figure 4:
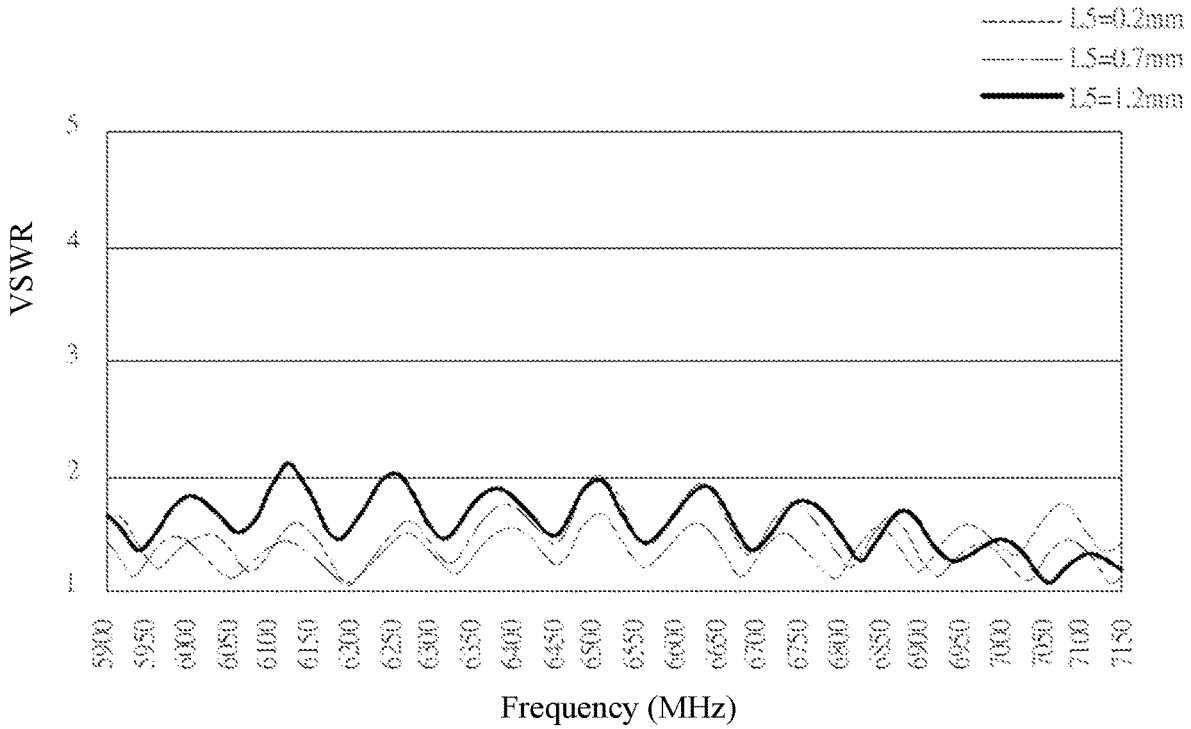
FIG. 4 is a diagram of a voltage standing wave ratio of the antenna structure under different frequencies and different fifth predetermined lengths according to FIG. 2.

Referring to FIG. 4, FIG. 4 is a diagram of a voltage standing wave ratio of the antenna structure under different frequencies and different fifth predetermined length L5 according to FIG. 2. In FIG. 4, the frequency range from 5.925 GHz to 7.125 GHz in FIG. 3 is enlarged, and the fifth predetermined length L5 adopted in FIG. 3 is changed from 0.2 mm to 0.7 mm and 1.2 mm. It can be seen from FIG. 4 that when the fifth predetermined length L5 between the feeding portion 23 and the second extension portion 40 becomes larger, the mode from 5.925 GHz to 7.125 GHz will have the effect of matching and offset. The reason is that the fifth The predetermined length L5 becomes larger, which reduces the amount of coupling between the feeding metal radiator 2 and the second grounded metal radiator 4, which in turn affects the frequency of 5.925 GHz to 7.125 GHz that the second grounded metal radiator 4 resonates. It can be seen from FIG. 4 that the preferred adjustment range of the fifth predetermined length L5 can be from 0.1 mm to 1.5 mm, but according to different requirements, the adjustment range of the fifth predetermined length L5 is 0.1 mm to 3 mm.

Figure 5:
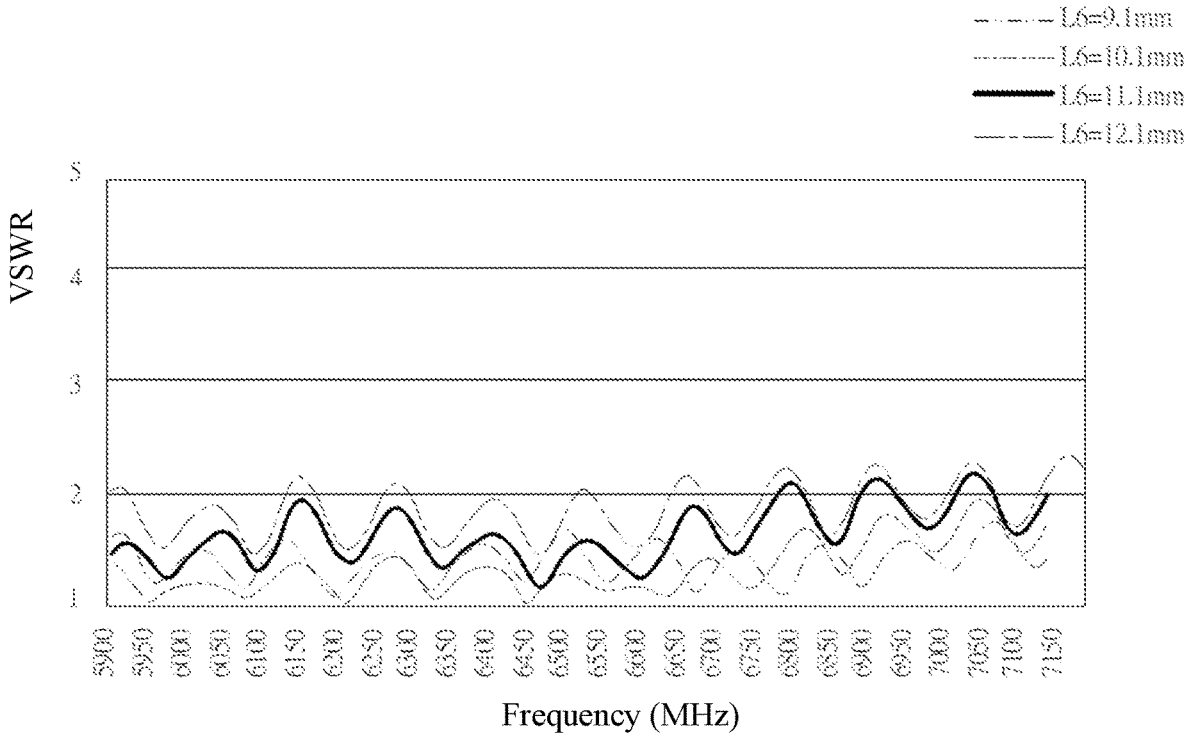
FIG. 5 is a diagram of a voltage standing wave ratio of the antenna structure under different frequencies and different sixth predetermined lengths according to FIG. 2.

Referring to FIG. 5, FIG. 5 is a diagram of a voltage standing wave ratio of the antenna structure under different frequencies and different sixth predetermined length L6 according to FIG. 2. In FIG. 5, the frequency range from 5.925 GHz to 7.125 GHz in FIG. 3 is also enlarged, and the sixth predetermined length L6 adopted in FIG. 3 is changed from 9.1 mm to 10.1 mm, 11.1 mm, and 12.1 mm. It can be seen from FIG. 5 that when the sixth predetermined length L6 of the second grounded metal radiator 4 in the first direction D1 changes, it will affect the resonance frequency of the antenna structure U, especially offset phenomenon in the 5.925 GHz to 7.125 GHz mode. The reason for the offset phenomenon is that the resonant wavelength of the antenna structure U becomes longer, which in turn affects the frequency of 5.925 GHz to 7.125 GHz resonated by the second grounded metal radiator 4. It can also be seen from FIG. 5 that the preferable adjustment range of the sixth predetermined length L6 can be from 9.1 mm to 12.1 mm, but according to different needs, the adjustment range of the sixth predetermined length L6 is 7 mm to 15 mm.

One of the beneficial effects of the present disclosure is that the antenna structure provides the improved design concept of the open slot antenna structure, increases the coupling between the antenna radiator path and the feeding point, and resonates the required frequency band of WI-FI® 6E (5.925 GHz~7.125 GHz), so that the design of communication products does not need to increase space for the antenna design for the WI-FI® 6E communication frequency band, and there is no need to make additional changes in the mechanism. The number of antennas can be reduced, and the molding cost can also be reduced.

Furthermore, based on the antenna structure provided by the present disclosure, on the premise of preserving the gap between the first extension portion and the second extension portion, it further improves the overall performance of the antenna structure by adjusting the gap between the second grounded metal radiator and the feeding portion and adjusting the size of the second grounded metal radiator in the first direction.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A antenna structure, disposed on a metal back cover, the metal back cover having an open slot, the open slot having an open end and a closed end which are arranged along a first direction and having a first side and a second side which are arranged along a second direction, wherein the first direction is perpendicular to the second direction, the antenna structure comprising:

a feeding metal radiator disposed on the first side of the open slot and comprising:

a first radiating portion extended along the second direction from the first side of the open slot and overlapped by a first portion of the open slot;

a first connecting portion connected to the first radiating portion;

a second radiating portion coupled with the first radiating portion via the first connecting portion, wherein the first radiating portion, the first connecting portion and the second radiating portion are arranged along the first direction; and a feeding portion connected to the second radiating portion and extended along the second direction from the first side of the open slot and overlapped by at least one portion of the open slot, wherein the feeding portion having a feeding point coupled with a signal source;

a first grounded metal radiator, comprising:

a first extension portion extended along the second direction from the second side of the open slot and overlapped by a second portion of the open slot; and a first ground portion coupled with the first extension portion and a ground potential;

a second grounded metal radiator, comprising:

a second extension portion extended along the second direction from the second side of the open slot and overlapped by a fourth portion of the open slot, wherein the second extension portion is separated from the first extension portion by a first gap; and a second ground portion coupled with the second extension portion, the first ground portion and the ground potential; and a substrate;

wherein the feeding metal radiator, the first grounded metal radiator and the second grounded metal radiator are disposed on the substrate.

2. The antenna structure of claim 1, wherein the feeding metal radiator and the open slot generate a first frequency band and a second frequency band, the feeding metal radiator and the first grounded metal radiator generate a third frequency band, and the feeding metal radiator and the second grounded metal radiator generate a fourth frequency band.

3. The antenna structure of claim 1, wherein a vertical projection position of the feeding point onto the substrate is in a first area of the open slot, the open slot has a first predetermined length in the first direction, and the first area is positioned within a half of the first predetermined length of the open slot from the closed end.

4. The antenna structure of claim 3, wherein the first area exceeds a second predetermined length over the first side and the second side respectively in the second direction.

5. The antenna structure of claim 4, wherein the first determined length is in a range of 15 mm to 20 mm.

6. The antenna structure of claim 4, wherein the first determined length is in a range of 1 mm to 3 mm.

7. The antenna structure of claim 1, wherein the first grounded metal radiator further comprises a third extension portion which is between the first extension portion and the second extension portion, the third extension portion is coupled with the first ground portion, and the third extension portion is extended along the second direction from the second side of the open slot and is overlapped by a fifth portion of the open slot, wherein the third extension portion is separated from the first extension portion by a second gap and is separated from the second extension portion by a third gap.

8. The antenna structure of claim 7, wherein the third gap is in a range of 0.2 mm to 0.8 mm.

9. The antenna structure of claim 1, wherein a length of a connected part between the first ground portion and the second ground portion along the second direction has a third predetermined length, the second grounded metal radiator has a fourth predetermined length along the second direction, and the third predetermined length is smaller than or equal to a half of the fourth determined length.

10. The antenna structure of claim 1, wherein the second grounded metal radiator further comprises a second connecting portion, the second connecting portion is connected between the second ground portion and the second extension portion, and a fourth gap is between the second ground portion and the second extension portion.

11. The antenna structure of claim 1, wherein the first extension portion overlaps a first sub-portion and a second sub-portion of the second portion of the open slot, the first sub-portion is completely across the open slot, and the second sub-portion across a part of the open slot.

12. The antenna structure of claim 1, wherein the feeding portion is separated from the second extension portion by a fifth predetermined length.

13. The antenna structure of claim 12, wherein the fifth determined length is in a range of 0.1 mm to 3 mm.

14. The antenna structure of claim 12, wherein the second extension portion has a sixth predetermined length along the first direction and the sixth predetermined length is in a range of 7 mm to 15 mm.

15. A mobile device, comprising:

a metal back cover, having an open slot, the open slot having an open end and a closed end which are arranged along a first direction and having a first side and a second side which are arranged along a second direction, wherein the first direction is perpendicular to the second direction; and an antenna structure comprising:

a feeding metal radiator disposed on the first side of the open slot and comprising:

a first radiating portion extended along the second direction from the first side of the open slot and overlapped by a first portion of the open slot;

a first connecting portion connected to the first radiating portion;

a second radiating portion coupled with the first radiating portion via the first connecting portion, wherein the first radiating portion, the first connecting portion and the second radiating portion are arranged along the first direction; and a feeding portion connected to the second radiating portion and extended along the second direction from the first side of the open slot and overlapped by at least one portion of the open slot, wherein the feeding portion having a feeding point coupled with a signal source;

a first grounded metal radiator, comprising:

a first extension portion extended along the second direction from the second side of the open slot and overlapped by a second portion of the open slot; and a first ground portion coupled with the first extension portion and a ground potential;

a second grounded metal radiator, comprising:

a second extension portion extended along the second direction from the second side of the open slot and overlapped by a fourth portion of the open slot, wherein the second extension portion is separated from the first extension portion by a first gap; and a second ground portion coupled with the second extension portion, the first ground portion and the ground potential; and a substrate;

wherein the feeding metal radiator, the first grounded metal radiator and the second grounded metal radiator are disposed on the substrate.

16. The mobile device of claim 15, wherein a vertical projection position of the feeding point onto the substrate is in a first area of the open slot, the open slot has a first predetermined length along the first direction, and the first area is positioned within a half of the first predetermined length of the open slot from the closed end.

* * * * *